US005897747A

United States Patent [19]

Monroe

[11] Patent Number: 5,897,747

[45] Date of Patent: Apr. 27, 1999

[54] MACHINE DIRECTION PROFILING OF EXTENDED NIP PRESS SHOE

[75] Inventor: Paul D. Monroe, De Pere, Wis.

[73] Assignee: Beloit Technologies, Inc., Wilmington, Del.

[21] Appl. No.: 08/908,853

[22] Filed: Aug. 8, 1997

[51] Int. Cl.[6] ..... D21F 3/06

[52] U.S. Cl. ..... 162/205; 162/358.3; 162/361

[58] Field of Search ..... 162/358.3, 361, 162/205; 100/153

[56] References Cited

U.S. PATENT DOCUMENTS

| | | |
|---|---|---|
| Re. 30,268 | 5/1980 | Justus . |
| 3,293,121 | 12/1966 | Martin . |
| 3,974,026 | 8/1976 | Emson et al. . |
| 4,091,517 | 5/1978 | Lehmann et al. . |
| 4,287,021 | 9/1981 | Justus et al. . |
| 4,328,744 | 5/1982 | Pav et al. . |
| 4,425,190 | 1/1984 | Cronin . |
| 4,427,492 | 1/1984 | Cronin . |
| 4,428,797 | 1/1984 | Cronin . |
| 4,518,460 | 5/1985 | Hauser et al. . |
| 4,568,423 | 2/1986 | Laapotti . |
| 4,570,314 | 2/1986 | Holik et al. . |
| 4,576,682 | 3/1986 | Laapotti . |
| 4,673,461 | 6/1987 | Roering et al. . |
| 4,705,602 | 11/1987 | Dahl . |
| 4,713,147 | 12/1987 | Saarinen . |
| 4,917,767 | 4/1990 | Ilmarinen et al. . |
| 4,917,768 | 4/1990 | Ilmarinen . |
| 4,973,384 | 11/1990 | Crouse et al. . |
| 5,047,122 | 9/1991 | Crouse et al. . |
| 5,110,417 | 5/1992 | Lehtonen et al. . |
| 5,167,768 | 12/1992 | Cronin et al. . |
| 5,441,604 | 8/1995 | Sandberg et al. . |
| 5,753,084 | 5/1998 | Bubik et al. ..... 162/358.3 |

FOREIGN PATENT DOCUMENTS

| | | |
|---|---|---|
| 2173778 | 10/1996 | Canada . |
| 218 918 A1 | 2/1985 | Germany . |
| 195 14 142 | 7/1996 | Germany . |

OTHER PUBLICATIONS

"The Relative Importance of Wet Press Variables in Water Removal", L. R. Bueker and D.C. Cronin, Rockton Research & Development Lab, Beloit Corporation, Rockton, Illinois, 1982.

*Primary Examiner*—Karen M. Hastings
*Attorney, Agent, or Firm*—Raymond W. Campbell; Gerald A. Mathews

[57] ABSTRACT

An extended nip press having a concave shoe which is supported on a hydraulic actuator which urges the shoe against a backing roll. A pair of opposed profile control hydraulic actuators apply a pure couple about the load support line formed by a bearing pin which transmits the support load from the hydraulic actuator to the shoe. A leading hydraulic actuator is positioned in front of the load support line and pulls down on the shoe. A trailing hydraulic actuator is positioned behind the load support line and pushes up on the shoe. The leading hydraulic actuator and trailing hydraulic actuator are equally spaced from the load support line and have equal hydraulic actuator area and are connected to the same hydraulic reservoir. Thus the hydraulic actuators exactly balance each other out except for the couple or torque which they apply about the load support line.

5 Claims, 2 Drawing Sheets

MACHINE DIRECTION PROFILING OF EXTENDED NIP PRESS SHOE

FIELD OF THE INVENTION

The present invention relates to papermaking machines in general and to extended nip presses in particulars.

BACKGROUND OF THE INVENTION

Paper is made from a stock contained over 99 percent water and less that 1 percent fiber by weight. The stock is formed into a web which has a water content of less than 5 percent by weight. The paper making process consists of forming a web from the dilute stock suspension of fibers in water by removing the water from the web. The removal of water from the formed web must typically be accomplished in a way which maximizes web strength, maximizes web thickness and minimizes cost.

Water is removed through three principal mechanisms: draining, pressing, and drying. Typically the draining process is the least costly. In draining, the fiber content of the web is taken from the stock fiber content of less than one percent to between about 10 and 15 percent. Next the fiber content is increased to between 30 and 35 percent fiber by pressing water from the web. The remainder of the water which must be removed to increase the web fiber content to 95 percent fiber is accomplished by drying the web.

Drying is typically accomplished by wrapping the web about steam heated dryer rolls and evaporating the water from the web. Drying is an expensive process because of the heat energy which must be supplied to evaporate water from the web. Because the drying process is relatively slow, the number and size of dryers required to remove the water remaining after pressing contributes to a considerable fraction of the overall cost of a papermaking machine. Furthermore, the dryers take up a majority of the volume occupied by the papermaking machine.

To improve the performance of papermaking machines and to facilitate operating at higher speed, the extended nip press was developed. Pressing a paper web typically involves passing the web supported between two press fabrics through a nip formed between two rolls. The pressure developed in the nip presses water from the web into the supporting press fabrics. The nip between two rolls has a width in the machine direction of less than one inch. The width of a nip between two rolls can be increased to a limited extent by making one or both of the rolls compliant. On the other hand an extended nip press employs a shoe which has a concave contact surface which engages the backing roll to form a nip having a width of 8 to 12 inches in the machine direction.

The extended nip press shoe is placed within a looped blanket which slides over the concave surface of the shoe on a film of oil. A paper web supported between pressing felts is passed between the backing roll and the blanket supported by the shoe. The shoe is mounted on a bearing pin to a hydraulic actuator which urges the shoe against the backing roll. The greater width of the nip in an extended nip press allows more time for water to move from the web into the press felt. By removing more water in the pressing section the web fiber content can be increased to forty to forty-five percent or more. This reduces the number of dryers required in the dryer section and the amount of energy required to dry the web. This results in a considerable increase in overall economic efficiency in a papermaking machine.

In an extended nip press, where the shoe is supported on a single pin, the pressure on the web as it moves through the extended nip is controlled by the shape of the shoe and the position of the pin beneath the shoe.

One problem with an extended nip press is that as the pressure in the nip decreases as the web leaves the nip, water can move from the press fabric back into the web, rewetting it. To overcome this problem, the pressure profile of the nip in the machine direction is tailored to increase the pressure towards the trailing or exit side of the nip. This increased pressure can overcome or decrease rewetting.

Various ways of achieving a pressure profile of a certain characteristic have been developed. The placement of the support pin and the shape of the shoe can control the pressure profile. Other techniques employ two hydraulic support actuators under the shoe. These techniques involve moving the center of support beneath the shoe. It is often desirable to be able to adjust the loading between the shoe and the backing roll as well as the shape of the pressure profile while the machine is running. Various furnishes used to form a paper web may require varying the total nip pressure and nip pressure profile.

Controlling paper quality over time may also require adjusting the total nip pressure as well as the shape of the nip pressure profile. Current techniques for performing this operation result in the center of support moving when the shape of the nip pressure profile is varied. Varying the center of support can limit the ability to independently control the two variables of nip pressure profile shape and nip total load.

What is needed is an extended nip press where the shoe support system can vary the nip loading and the shape of the pressure profile independently.

SUMMARY OF THE INVENTION

The extended nip press of this invention has a shoe which is supported on a central hydraulic actuator. The actuator has a piston which engages the shoe along a load support line formed by a pin. The piston urges the shoe against a backing roll. A pair of hydraulic actuators applies a pure couple about the load support line to the shape of the nip pressure profile. Total nip loading, typically specified in pounds per linear inch (pli) in the cross machine direction, is supplied by the hydraulic actuator positioned beneath the shoe. This actuator engages the shoe support bearing pin. The pin extends beneath the shoe in a cross machine direction. Typical extended nip loading is 1,200–8,500 pli. The pair of hydraulic actuators includes a leading hydraulic actuator and a trailing hydraulic actuator. The leading hydraulic actuator is positioned in front of the load support line and pulls down on the shoe. The trailing hydraulic actuator is positioned behind the load support line and pushes up on the shoe. The leading hydraulic actuator and trailing hydraulic actuator are equally spaced from the load support line. Each of the leading and trailing hydraulic actuators have moving surfaces of equal area and are connected to the same hydraulic reservoir. Thus the hydraulic actuators exactly balance each other out and supply a pure torque applied about the load support line.

While the total nip loading in pounds per linear inch is controlled by the central hydraulic actuator beneath the support pin, the shape of the pressure profile is controlled by the leading and trailing hydraulic actuators which supply a couple which controls the shape but not the magnitude of the pressure profile.

For a typical nip loading of 6,000 lbs. per linear inch a total couple of 6,000 inch-pounds may be applied. This can be accomplished by the leading hydraulic actuator applying a downwardly directed load of 600 pounds at a distance of five inches in front of the load support line. And the trailing hydraulic actuator applying an upwardly directed load of 600 pounds, at a distance of five inches behind the load support line.

It is a feature of the present invention to provide an extended nip press which allows total nip load and nip pressure profile to be independently controlled.

It is a further feature of the present invention to provide an extended nip press where the line of support for the shoe does not move.

It is a yet further feature of the present invention to provide an extended nip press capable of removing more water from a web passing through the press.

It is a still further feature of the present invention to provide a method of controlling the pressure profile in an extended nip press.

Further objects, features and advantages of the invention will be apparent from the following detailed description when taken in conjunction with the accompanying drawings.

DESCRIPTION OF THE PREFERRED EMBODIMENT

Figure 3:
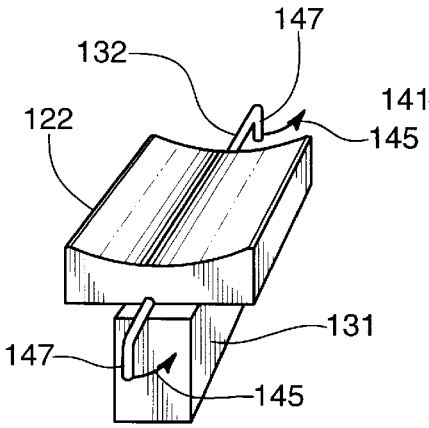
FIG. 3 is a schematic isometric view of the shoe support systems of FIG. 2.
Figure 4:
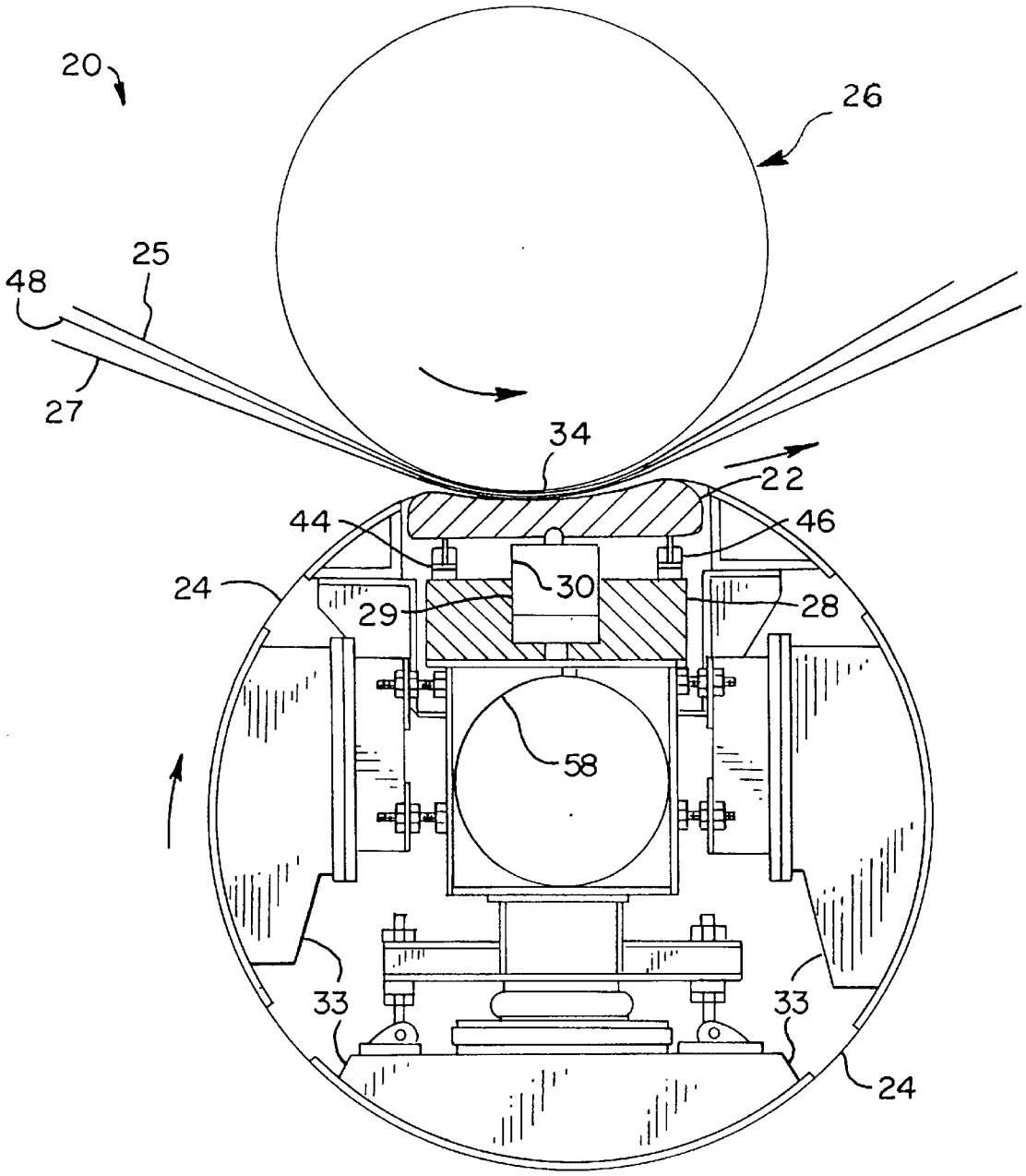
FIG. 4 is a schematic cross-sectional view of an extended nip press employing the nip shoe support system of FIG. 1.

Referring more particularly to FIGS. 1–4 wherein like numbers refer to similar parts, an extended nip press 20 is shown in FIG. 4. The press 20 employs a concave shoe 22 mounted inside a blanket 24. The shoe is urged against a backing roll 26 by a shoe support system 28. A paper web 48 held between an upper pressing fabric 25 and a lower pressing fabric 27 is drawn between the blanket 24 and the backing roll 26.

Figure 1:
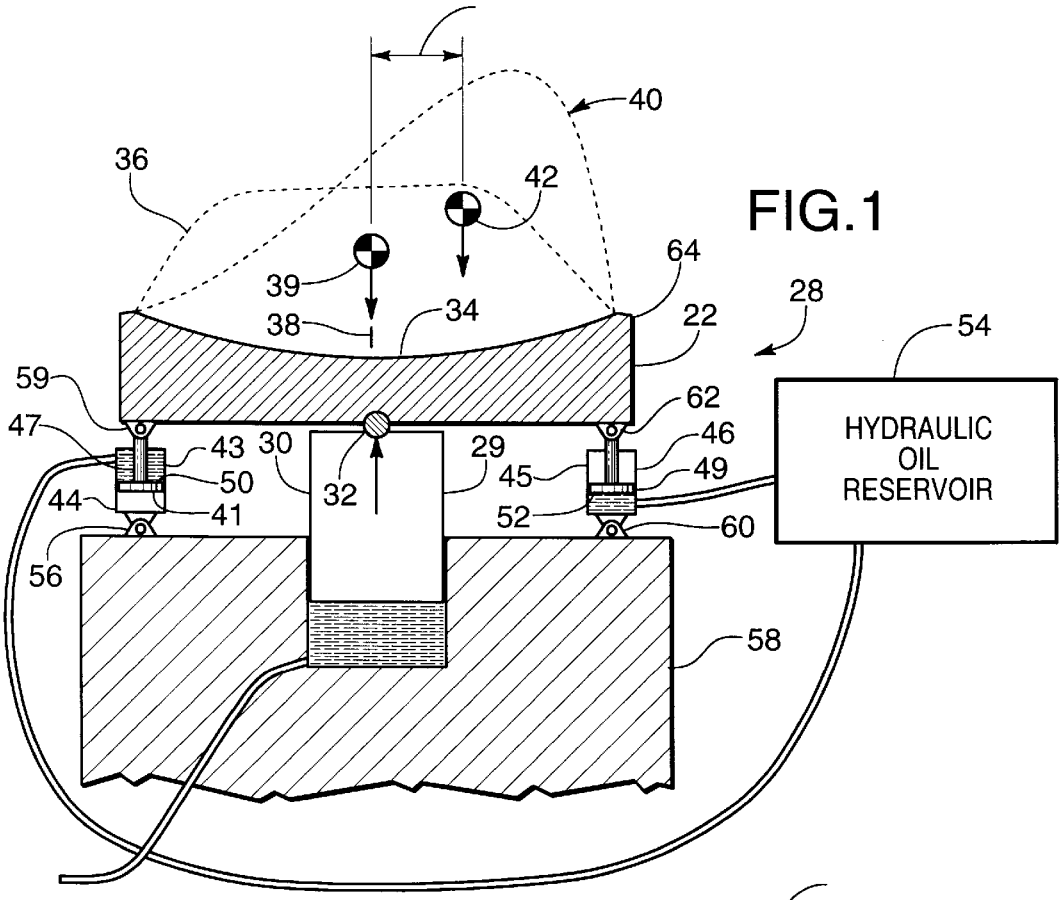
FIG. 1 is a schematic cross-sectional view of the extended nip press shoe support system of this invention.

The shoe support system 28, best shown in FIG. 1, has a central support hydraulic actuator 29 with a piston 30 which engages a cross-machine bearing pin 32 which supports the shoe 22. The central hydraulic actuator 29 is supported on a cross machine direction beam 58 which also supports guides 33 for the blanket 24.

Figure 2:
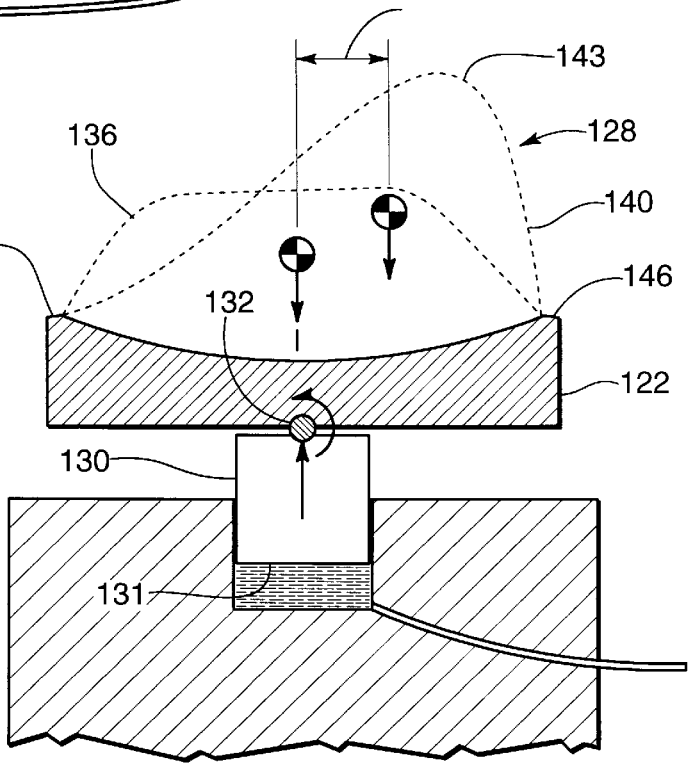
FIG. 2 is a schematic cross-sectional view of an alternative embodiment extended nip shoe support system.

The shoe support system 28 by way of the central piston 30 supplies pressure to a nip 34 formed between the backing roll 26 and the shoe 22. The total nip pressure, as measured in lbs. per linear inch in the cross machine direction, is between 1,200–8,500 pli. This pressure is distributed in the machine direction along the width of the nip 34 formed between the shoe 22 and the backing roll 26. The pressure in the nip 34 presses water from the web 48 into the press fabrics 25, 27. FIG. 1 shows a nip load profile 36 which represents the total loading the piston 30 applies to the shoe 22 which is reacted by the backing roll 26 as shown in FIG. 2. As required by a static analysis, the sum of the forces normal to the nip are equal to the applied load.

If all forces are applied by the central piston 30 through the bearing pin 32, then the moments about the pin 32 must be zero. For the moments to be balanced, the forces must be balanced about a vertical plane 38 extending through the pin 32. This is the same as saying the center of gravity 39 of the pressure profile 36 must lie above the center of the bearing pin 32.

If a balanced force couple is used to apply a torque about the center of the pin 32 the total load, and therefore the total area under the nip profile curve 40 remains the same. The center of gravity 42, however, is displaced by a distance to balance the torque.

As shown in FIG. 1, a leading hydraulic actuator 44 and a trailing hydraulic actuator 46 are arranged to apply a pure torque about the center of the bearing pin 32. The leading actuator 44 has a piston 41 which moves within an actuator cylinder 43. The trailing actuator 46 has a piston 49 which moves within an actuator cylinder 45. As shown in FIG. 4 a paper web 48 moves from left to right defining an upstream direction to the left and a downstream direction to the right. The leading hydraulic actuator 44 is balanced with the trailing hydraulic actuator 46 by placing the hydraulic actuators 44, 46 equidistant from and on opposite sides of the pivot pin 32. The forces applied by the actuators 44, 46 may be conveniently made the same by sizing the moving surfaces 50, 52 of the hydraulic actuator pistons 41, 49 to have identical surface areas and connecting each the cylinders 43, 45 of each hydraulic actuator to the same hydraulic reservoir 54 and pump (pump not shown). As is well understood in the hydraulic art if the hydraulic pressure to two hydraulic actuators is the same then total actuation force depends on area of the hydraulic piston or more particularly the area normal to the direction of motion of the moving part of the actuator which develops the actuator force.

If the hydraulic actuators 44, 46 are as shown in FIG. 1, the leading hydraulic cylinder 43 will have a larger diameter then the trailing hydraulic cylinder 45 because the area of the piston rod 47 must be subtracted from the total area of the piston on which the hydraulic fluid can act.

The leading hydraulic actuator 44 has a pivot pin or universal mount 56 attaching the actuator 44 to the support beam 58. The actuator piston rod 47 is similarly attached to the shoe 22 by a mount 59. The trailing hydraulic actuator 46 also has a pivotal mount 60 which mounts the actuator 46 on the support beam 58 and a shoe mount 62 which provides a pivotal mount between the trailing actuator 46 and the shoe 22. The shoe 22 thus mounted is free to pivot about the pivot pin 32 in response to the couple or torque provided by the leading and trailing hydraulic actuators 44, 46.

The pressure profile 40 shown in FIG. 1 provides a steady increase in pressure as the web 48 moves through the nip 34 followed by a rapid drop in pressure at the trailing edge 64 of the shoe 22. This pressure profile is known to generally improve the performance of an extended nip press. It improves the amount of water removal from the web and decreases the amount of rewetting from the press fabrics. The pressure profile provides a relatively gradual increase in pressure in the nip without causing crushing or dislocation of the fibers. When a heated backing roll which engages the web directly is used, the pressure profile is also important in preventing delamination and in improving the properties of the web.

In some prior art methods of controlling nip pressure profile it was necessary to change the position of the bearing pin 32 or it was necessary to adjust the shape of the shoe. These operations could only be performed while the machine was down for major maintenance. Other approaches to adjusting the nip profile while the extended nip press was in operation invariably lack an ability to independently control total nip pressure and the nip pressure profile.

Advancements in papermaking are moving in the direction of monitoring the quality of the paper being formed and adjusting various parameters of the papermaking machine to control web properties in realtime or near realtime. Control algorithms and laws are easier to understand and design if paper formation variables can be independently varied.

It may also be observed that while science is making major contributions to the manufacture of paper, papermaking remains an art. This is apparent because, while individual parameters of the papermaking process such as nip pressure profile need to be varied for different furnishes and paper grades, the paper web being formed also benefits from continuous adjustments to nip pressure profile in response to measured web quality. These adjustments may be necessary although the furnish and other parameters of the papermaking process are as nearly as possible maintained unchanged. Thus independent control of total nip pressure, and nip pressure profile shape carries with it the prospect of better control of the papermaking process.

An alternative embodiment shoe support system 128 is shown in FIGS. 2 and 3. In this system a torque is applied directly to a bearing pin 132 which is welded or fixed to a shoe 122. The torque results in the pressure profile 136 being changed to the pressure profile 140 which has the beneficial shape in which the pressure steadily increases from a leading edge 141 to a pressure maximum 143 after which pressure rapidly drops off steeply towards a trailing edge 146.

The bearing pin 132 is supported by a hydraulic actuator 130 which has a piston 131 which bears against the pin 132. Total nip pressure as defined by the area under the curve 136 and is supplied by the hydraulic actuator 130. A torque applied to the pin 132 causes the center of gravity of the nip pressure profile 136 to shift to the right or downstream side of the shoe resulting in a pressure profile 140 shown in FIG. 2. FIG. 3 shows how access to the bearing pin 132 can be gained by extending the pin out from under the shoe 122 and applying bending forces indicated by arrows 145 to the bearing rod 132. FIG. 3 makes clear how a torque can be applied to the bearing pin 132 and through the bearing into the shoe 122. As will be clear to those skilled in the mechanical arts, the arms 147 to which the torque is applied could be contained within the piston 131 if a single piston is used to support a continuous shoe. On the other hand, if multiple pistons are positioned beneath the shoe the torque-applying arms can be positioned between the pistons.

It is understood that the invention is not limited to the particular construction and arrangement of parts herein illustrated and described, but embraces such modified forms thereof as come within the scope of the following claims.

I claim:

1. An extended nip press for use in a papermaking machine comprising:

a backing roll for supporting and guiding a web of paper, the backing roll extending in a cross machine direction and mounted for rotation;

a shoe extending in a cross machine direction, the shoe being disposed within a looped blanket and supported on a beam which extends in the cross machine direction, the shoe being opposed to the backing roll and having a surface extending in a machine direction to engage the backing roll along a substantial machine direction width;

a pressing fabric positioned between the blanket and the backing roll to engage the paper web therebetween, the pressing fabric moving through a nip formed between the shoe and the backing roll, the direction of motion of the pressing fabric defining an upstream machine direction and a downstream machine direction so that the pressing fabric moves through the nip from the upstream machine direction to the downstream machine direction;

a first hydraulic actuator positioned between the beam and the shoe and urging the shoe towards the backing roll;

a cross machine direction bearing pin positioned between the hydraulic actuator and the shoe;

a second hydraulic actuator positioned a selected distance in an upstream direction from the first hydraulic actuator and positioned between the support beam and the shoe;

a third hydraulic actuator positioned the selected distance, but in a downstream direction from the first hydraulic actuator and positioned between the support beam and the shoe, wherein the second hydraulic actuator acts to apply a force to the shoe directed towards the beam, and wherein the third hydraulic actuator acts to apply a force to the shoe directed towards the backing roll, the force applied by the second hydraulic actuator being of the same magnitude but opposite in direction the force applied by the third hydraulic actuator.

2. The press of claim 1 wherein the second hydraulic actuator and the third hydraulic actuator have moving surfaces upon which high pressure hydraulic fluid acts and wherein the surface areas of the moving surfaces are identical so that the forces generated by the second hydraulic actuator and the third hydraulic actuator are identical and wherein the second hydraulic actuator is in hydraulic receiving relationship to a hydraulic reservoir, and the third hydraulic actuator is in hydraulic receiving relationship to the reservoir so the forces generated by the first and second hydraulic actuators are identical in magnitude while opposite in direction.

3. An extended nip press for use in a paper making machine comprising:

a backing roll for supporting and guiding a web of paper, the backing roll extending in a cross machine direction and mounted for rotation;

a shoe extending in a cross machine direction, the shoe being disposed within a looped blanket and supported on a beam which extends in the cross machine direction, the shoe positioned to form a nip with the backing roll, the shoe having a concave surface extending in a machine direction;

a press fabric positioned between the blanket and the backing roll to engage the paper web therebetween;

a first hydraulic actuator positioned between the beam and the shoe for urging the shoe towards the backing roll;

a cross machine direction pin on which the shoe bears, the pin positioned between the hydraulic actuator and the shoe;

a second hydraulic actuator positioned a first distance upstream in the machine direction from the first distance hydraulic actuator and positioned between the support beam and the shoe; and a third hydraulic actuator positioned the first distance in the machine direction downstream from the first hydraulic actuator, wherein the pin is between and equidistant from the second hydraulic actuator and the third hydraulic actuator, the third hydraulic actuator positioned between the support beam and the shoe, wherein the second hydraulic actuator acts to apply a force to the shoe such that the upstream side of the shoe is pivotally directed towards the beam, and wherein the third hydraulic actuator acts to apply a force to the shoe such that the downstream side of the shoe is pivotally directed towards the backing roll, and wherein the force applied by the second hydraulic actuator is of the same magnitude but opposite in direction to the force applied by the third hydraulic actuator.

4. A method for controlling an extended nip pressure profile in a machine direction formed between a backing roll and a shoe, and independently controlling the shape of the pressure profile, the method comprising the steps of:

applying a hydraulic load to a single support pin positioned between a shoe and a support hydraulic actuator so that the shoe is urged against a backing roll solely along a bearing line formed by the pin; and simultaneously applying torque about the bearing line so that the shoe is urged to rotate about the bearing line, the combination torque and hydraulic load controlling the shape of the pressure distribution between the shoe and the backing roll, and wherein the torque is applied by actuating a second hydraulic actuator positioned a first distance upstream in the machine direction from the bearing line and positioned between the support beam and the shoe to apply a force of a first magnitude such that the shoe is pivotally moved away from the backing roll; and actuating a third hydraulic actuator positioned the first distance in the machine direction from the bearing line, the bearing line being between, and equidistant from, the second hydraulic actuator and the third hydraulic actuator, and applying a force equal to the first magnitude to the shoe, but towards the backing roll.

5. An extended nip press for a papermaking machine comprising:

a backing roll for supporting and guiding a web of paper, the backing roll extending in a cross machine direction and mounted for rotation;

a beam which is spaced from the backing roll;

a concave shoe extending in a cross machine direction and opening toward the backing roll, an extended nip being defined between the shoe and the backing roll;

a blanket which encircles the shoe and extends through the nip;

a bearing pin which extends in the cross machine direction and which extends along the shoe extended nip;

a first actuator which extends between the beam and the bearing pin, the actuator for urging the shoe against the backing roll;

a press fabric extending through the extended nip to receive the paper web between the press fabric and the blanket;

a second hydraulic actuator positioned a first distance upstream from the pin, the second hydraulic actuator extending between the support beam and the shoe;

a third hydraulic actuator positioned the first distance, but downstream from the pin, the third hydraulic actuator extending between the beam and the shoe, wherein the second hydraulic actuator acts to apply a force of a first magnitude to direct the shoe towards the beam, and wherein the third hydraulic actuator acts to apply a force equal to the first magnitude to the shoe, but opposite in direction, directing the shoe towards the backing roll.

* * * * *